United States Patent [19]

Look

[11] 4,008,667

[45] Feb. 22, 1977

[54] CONTROLLED RANGE BULLET

[75] Inventor: Lance G. Look, Traverse City, Mich.

[73] Assignee: The L.O.M. Corporation, Traverse City, Mich.

[22] Filed: Dec. 13, 1973

[21] Appl. No.: 424,461

[52] U.S. Cl. ..... 102/88; 102/62; 244/3.28

[51] Int. Cl.[2] ..... F42B 13/00; F42B 13/32

[58] Field of Search ..... 102/62, 88; 244/3.1, 244/3.23, 3.27, 3.28, 3.29

[56] References Cited

UNITED STATES PATENTS

| | | | |
|---|---|---|---|
| 1,166,879 | 1/1916 | Alard | 244/3.29 |
| 1,181,203 | 5/1916 | Alard | 244/3.28 X |
| 1,201,763 | 10/1967 | Rimailho | 244/3.28 X |
| 1,276,575 | 8/1918 | Ross | 102/88 |
| 1,536,494 | 5/1925 | Henkes | 102/88 |
| 3,004,489 | 10/1961 | Griffith et al. | 102/88 X |
| 3,347,491 | 10/1967 | Pickart | 244/3.27 |

*Primary Examiner*—Stephen C. Bentley
*Assistant Examiner*—Harold Tudor
*Attorney, Agent, or Firm*—Frederick J. Olsson

[57] ABSTRACT

A bullet including the lead body in combination with a rotary aerodynamic brake. The brake is non-operative over a specified distance after firing so as not to degrade the bullet's lethal effectiveness. However, upon reaching the distance limit the brake operates to quickly reduce the speed and to stop the bullet so that it is no longer lethal.

1 Claim, 10 Drawing Figures

CONTROLLED RANGE BULLET

This invention relates to ammunition and in particular relates to a limited lethal range bullet which is particularly suitable for use in conventional hand guns and rifles.

More specifically, the invention relates to bullet structures which provide that after firing the bullet move through a specific distance within which there is lethal effectiveness but upon approaching the end of the specified distance a rotary aerodynamic brake begins to function to slow down the bullet and commensurately reduce its lethal effectiveness until the bullet is stopped and rendered harmless.

Safety is the primary feature of the bullets of the invention. The likelihood of a stray or random bullet striking an innocent bystander is minimized. The structure provides bullets for use by local law enforcement authorities where the lethal range is 25 to 100 feet. This is especially suitable for indoor work and for use in populated areas. Additionally the structure provides for outdoor use by hunters, game wardens and the like where longer lethal ranges are desired, for example, 100 to 200 feet.

Preferred forms for the invention will be described below in connection with the following drawings wherein.

Figure 1:
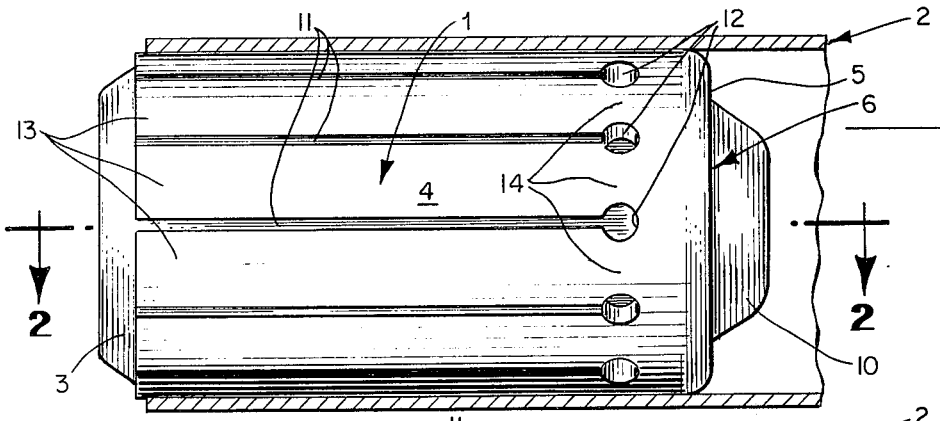
FIG. 1 is an elevational view of one form of a bullet constructed in accordance with the invention and disposed within a conventional cartridge, the components being in the non-fired condition.

A bullet structure for lethal effectiveness over short ranges of 25 to 100 feet will be described in connection with FIGS. 1–3.

The bullet 1 is shown disposed in the charge holding cartridge 2 in the non-fired condition. The bullet includes a generally cylindrical shaped elongated body 3 (FIG. 2) disposed within an aerodynamic brake 4. The brake has a base 5 and a wall 6. The base fits down over the end 7 of the body and the wall 6 surrounds the periphery of the body 3 and adapts the bullet to be press fitted in the cartridge 2. On the right hand end the body is upset to form a stop plate 10 which holds the base 5 firm against the end 6.

The wall is formed with a plurality of slits 11 each of which preferably terminate in an enlarged hole 12. The holes 12 are located adjacent the base 5. The portion of the wall between each pair of slits form a brake arm such as the arms 13. The root of each arm is formed by the area between the holes. The roots are indicated at 14.

The manner in which the bullet functions is described following:

When the bullet leaves the gun, the rifling causes it to spin at a high velocity for example 40,000 rpm. The centrifugal force operates on the arms 13. The brake is formed from soft copper and the thickness and width of each root is designed so that the centrifugal force acting on each arm is greater than the yield strength at the root and this allows the arm to rotate outwardly so that it assumes a radially extending position as shown by the dotted lines in FIG. 3. The tensile strength at the root, however, is greater than the centrifugal force acting on each arm so that the arm does not fly off.

When the arms 13 move out to the radial or the deployed position, the effect is to create a drag which slows down and stops the flight of the bullet. The drag increase can be in the order of 50:1 depending on arm size. At the high rotational speeds of the bullet, the drag forces are greatest because the arms act like a solid disc or cone. As the rotational speed decreases the disc opens, so to speak, and the drag forces become less. The radial position of each arm is a function of the centrifugal and drag forces acting on the arm.

Figure 2:
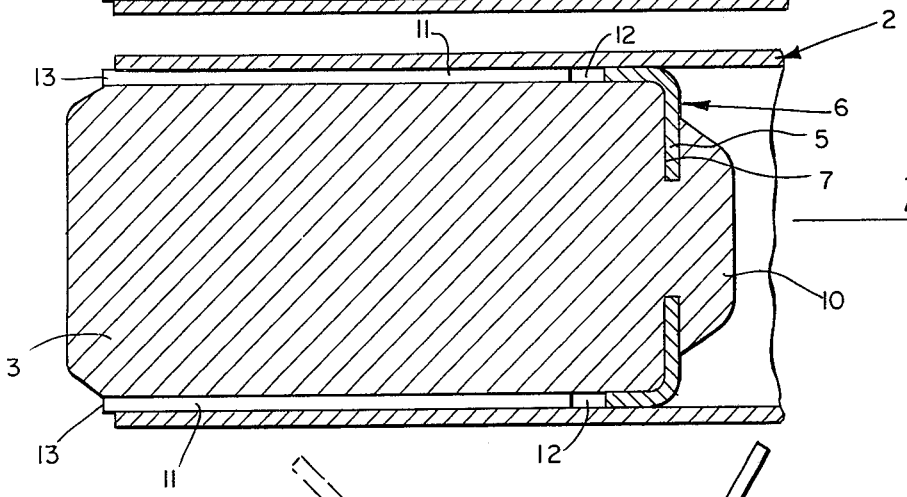
FIG. 2 is a sectional view taken along the lines 2—2 of FIG. 1.
Figure 3:
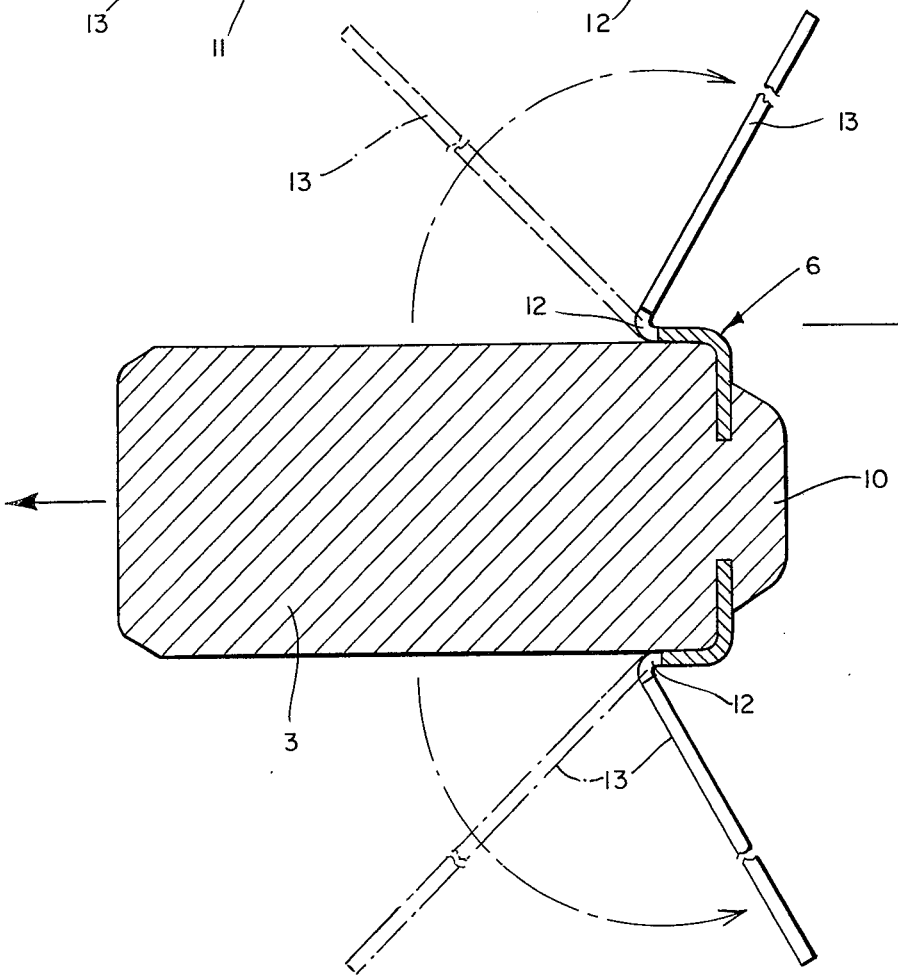
FIG. 3 is a sectional elevational view of the bullet of FIG. 1 in flight with the aerodynamic brake deployed.

The bullet of FIGS. 1 through 3 is a standard weight of approximately 158 grams. It is approximately 0.356″ OD and 0.730″ in overall length. The body is made of conventional lead core material used for bullets. The brake is formed of soft copper or copper alloy approximately 0.02″ thick. There are preferably 12 equi-spaced arms 13 formed by 0.010 slits 11 and 1/32″ diameter holes 12. As noted above, the bullet is for relatively short lateral range, e.g. 25 and 100 feet. The particular desired lethal range can be controlled by the length of the arms 13, e.g. for a range of about 25 feet the arm length is approximately 0.50″ and for a range of 100′ the arm length is approximately 0.20″. The cartridge with which the bullet is used is filled with standard explosive loading.

Figure 4:
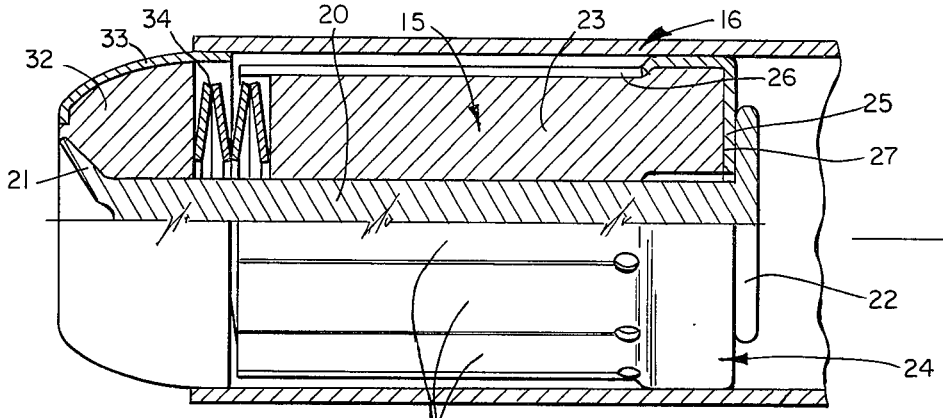
FIG. 4 is an elevational view partially in section of another form of bullet constructed in accordance with the invention and disposed within a cartridge in the non-fired condition.
Figure 5:
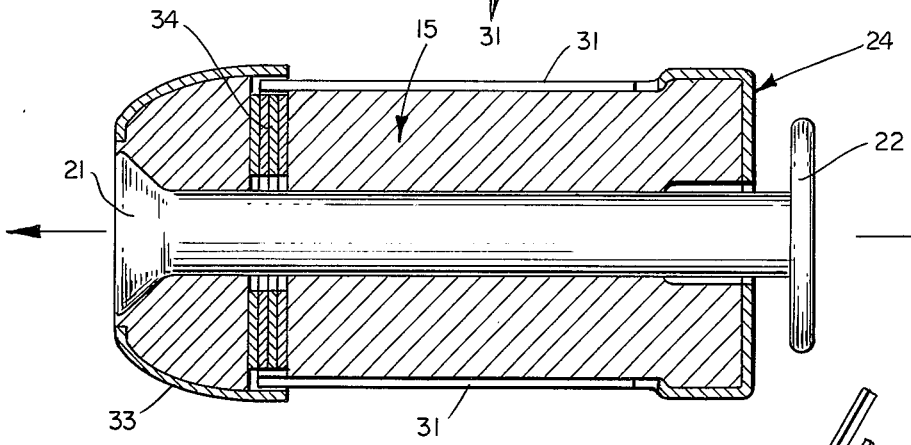
FIG. 5 is a sectional elevational view of the bullet of FIG. 4 with the components in position just after firing.
Figure 6:
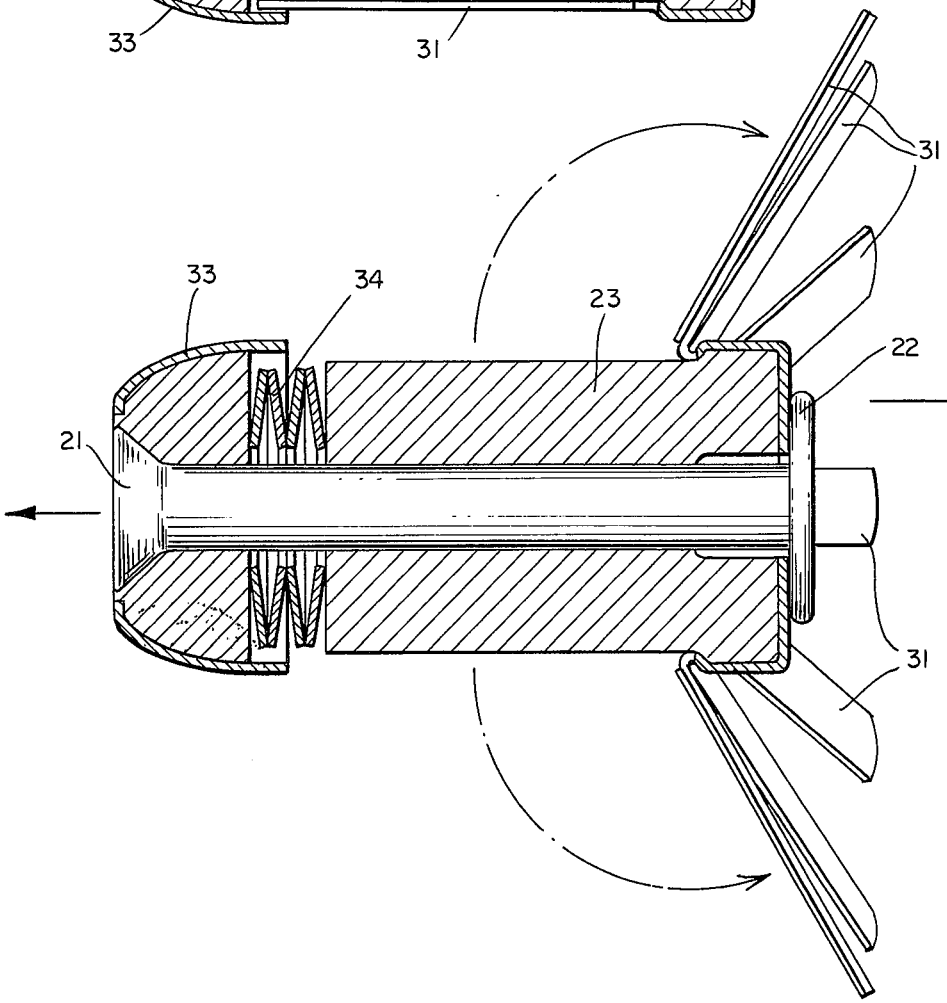
FIG. 6 is a sectional elevational view of the bullet of FIG. 1 in flight with the aerodynamic brake deployed.

In FIGS. 4 thru 6 I have shown a modified form of short range bullet. This is a refined version of the bullet of FIGS. 1–3. It has a time delay means which provides for bullet to exit from the turbulent gas area around the muzzle before the aerodynamic brake can become operative.

Refering to FIG. 4, the modified bullet is indicated at 15 and is disposed in the cartridge 16. The bullet includes an elongated retainer 20 having first and second stop plates 21 and 22. A generally cylindrically shaped elongated body 23 is slidably mounted on the retainer. A brake 24 similar to the brake 4 covers the body. The brake has a base 25 and a wall 26. The base 25 extends inwardly and engages the end 27 of the body. The wall 26 surrounds the body and adapts the bullet to be press fitted into the cartridge 16. The wall 26 is formed with arms 31 similar to the arms 13. The retainer supports an annular shaped nose 32 which in turn mounts the nose cup 33. An annular compression spring 34 surrounds the retainer and is confined between the nose 32 and the body 23.

In the unfired condition, the spring 34 reacts to force the nose to engage the stop plate 21 and the body to engage the stop plate 22. In the position of the components shown in FIG. 4 it will be noted that the nose cup is spaced from the ends of the arms 31 so as not to offer interference to outward rotation of the arms.

The manner in which the bullet of FIGS. 4-6 functions is explained following.

When the bullet is fired, the explosive forces react on the body and retainer. The inertia of the body and the inertia of the nose and retainer cause relative movement between the body and the nose in a direction to compress the spring 34 as shown in FIG. 5. In this position the nose cup overlies the arms and prevents arm rotation. When the explosive forces have dissipated the spring takes over and pushes the nose and body apart such as shown in FIG. 4. The nose cup is spaced from the arms and the same free to rotate outwardly so that the brake is deployed as shown in FIG. 6.

In the embodiment of FIGS. 4–6 the body and nose are formed from lead, the retainer formed from brass, the spring from beryllium-copper, and the nose cup and the brake from soft copper or copper alloy. Conventional fabricating techniques are employed. In assembling the bullet, the stop plate 21 is unformed so that the brake, the body, the spring, the nose and the nose cup can be assembled on the retainer. Then the end of the retainer is rolled to form the stop plate 21 and hold the parts in the position shown in FIG. 4.

In FIGS. 7 through 10 I have shown bullet structures which are especially adaptable for long range, e.g. where the lethal effect must extend out to between 100 - 200 feet or more. The bullets shown are equipped with time delay devices which prevent deployment of the aerodynamic brake over time periods to attain the desired lethal distance.

Figure 7:
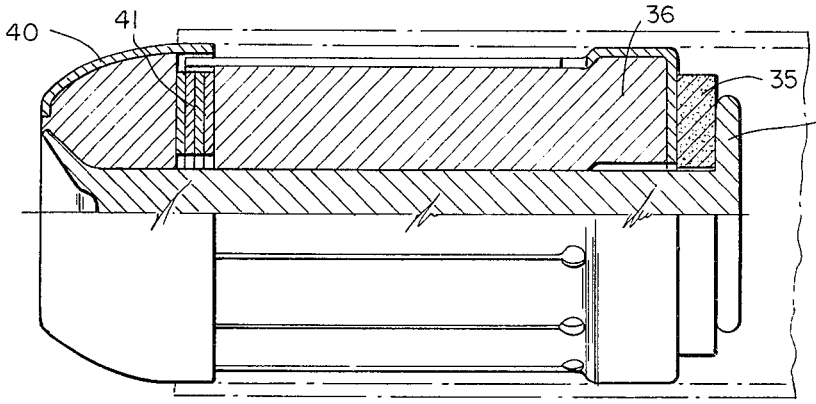
FIG. 7 is an elevational view partially in section of a modified form of bullet disposed in a cartridge in the non-fired condition.

In FIG. 7 I have shown an arrangement identical to the structure described in connection with FIGS. 4 through 6 except that a fuse 35 is sandwiched between the body 36 and stop plate 37. The fuse is disc-like in shape and is made of nitrocellulous or a nitroglycerine compound and has a coating of phospherous or sulphur which is ignited when the bullet is fired.

In the nonfired position of FIG. 7 it will be observed that the nose cup 40 overlies the arms and prevents rotation. During flight, the fuse 35 is consumed and the spring 41 will position the body up against the stop plate 37 (as in FIGS. 4 and 6). In this position the nose cup is spaced from the arms so that the same are free to rotate to the deployed position such as shown in FIG. 6.

The lethal range of the bullet of FIG. 7 is a function of the burn rate of the fuse 35. This is controllable by the type of material and the thickness of the disc. Also, a shell coating may be employed to achieve low initial burn rates. In any event, the burn rate is coordinated with the amount of overlap of the nose cap in determining the time for brake deployment.

Figure 8:
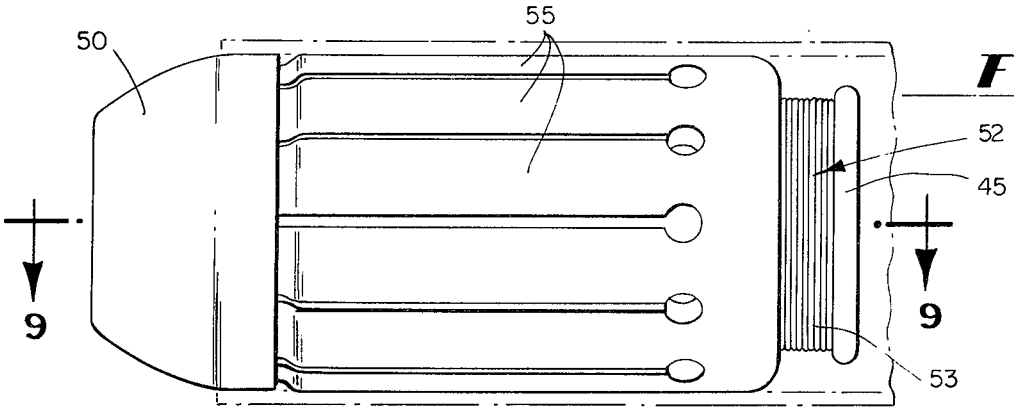
FIG. 8 is a side elevational view of a modified form of bullet disposed within a cartridge in the non-fired condition.
Figure 9:
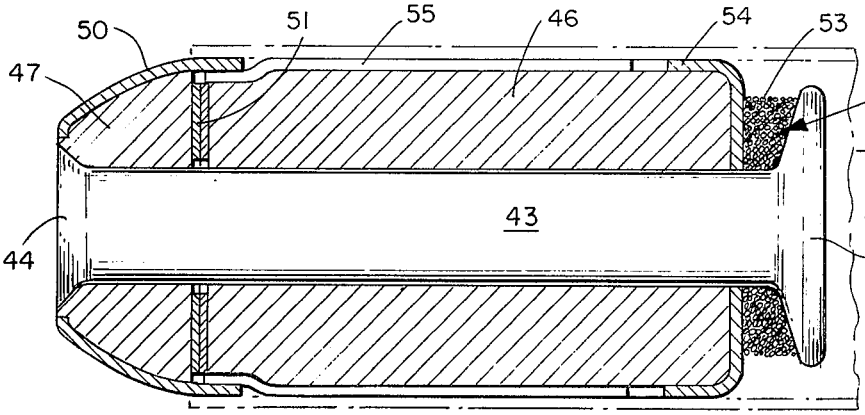
FIG. 9 is a view taken along the lines 9—9 of FIG. 8.

In FIGS. 8 and 9 I have shown a bullet with a mechanical type time delay. The bullet includes the retainer 43 with stop plates 44 and 45, a lead body 46 is mounted on the retainer. A nose 47 also mounted on the retainer carries a nose cup 50. A compression spring 51 is disposed between the nose and body. The time delay 52 comprises a nylon or metal line 53 which is wound around the retainer between the brake 54 and the stop plate 45. The time delay maintains the parts in the nonfired position shown.

After the bullet is fired the centrifugal force acting on the line 53 causes the line to gradually play out. As the line plays out the spring 51 forces the body 46 toward the stop plate 45. When the line is fully played out the arms 55 are free from the nose cup and rotate outwardly to the deployed position.

In FIGS. 8 and 9 the retainer, the body, the nose, the nose cap, the spring and the brake are made from the same materials as the corresponding parts in FIGS. 4 through 6.

Figure 10:
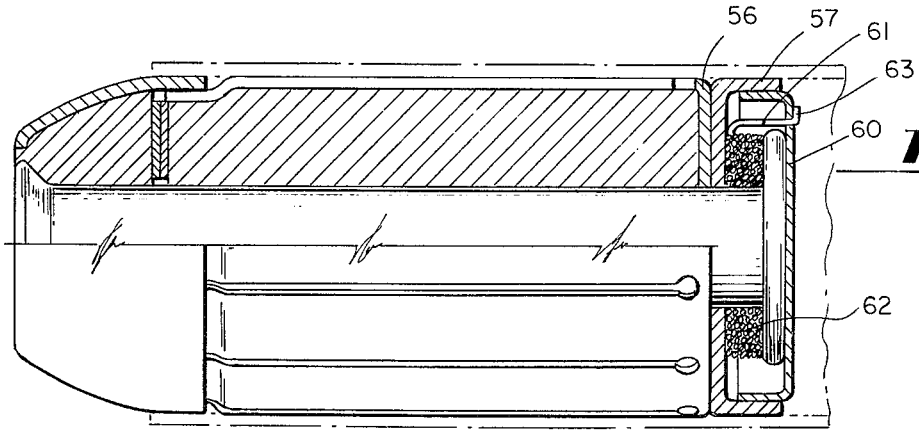
FIG. 10 is an elevational view partially in section of modified form of bullet disposed with a cartridge.

In FIG. 10 I have shown a modified version of the bullet of FIG. 9. The brake 55 carries a cut 57 within which is slidably fitted the tail piece 60. One end of the line 61 of the time delay 62 is adhesively secured to the tail piece at 63. When the bullet is fired the tail piece 60 slides away and remains behind. This causes the line 61 to play out. When the line is played out the bullet functions in the same manner as described in connection with FIGS. 8 and 9.

I claim:

1. In a controlled range bullet: an elongated retainer; first and second stop plates respectively disposed on opposite ends of said retainer;

a cylindrically shaped, elongated body surrounding and slidably mounted on said retainer;

a brake mounted on the body for movement therewith, the brake having a wall and a base, the base being engaged with one end of said body and the wall surrounding the periphery of said body and providing for the body to be fitted inside of a casing and the wall being formed with a plurality of slits each slit terminating in an enlarged hole the holes being located adjacent to said base, the portion of the wall between each pair of adjacent slits forming a brake arm with the root of the arm formed by the area between the holes of the pair of adjacent slits and when the bullet is fired from the muzzle of a gun which causes the bullet to spin, the centrifugal force acting on each arm developing a moment at the root of the arm whereby each arm rotates outwardly about its root and extends generally radially of the body the effect of the arm being to act as a rotary aerodynamic brake;

an annular shaped nose surrounding and mounted on said retainer;

a nose cup mounted on said nose;

an annular compression spring surrounding said retainer and extending between the nose and body, the spring, when the bullet is in the unfired condition, operating to cause the nose to engage said first stop plate and the body to engage said second stop plate and the engagement of the nose with the first stop plate causing the nose cup to be spaced from said arms in a direction to avoid interference with said rotation of the arms; and upon being fired from the muzzle of a gun which imparts rotation to the bullet, the bullet functioning as follows:

a. the explosive forces acting on the body and the retainer causing the body and the retainer to relatively move in a direction so that the spring is compressed and wherein the nose cup overlies said arms and prevents said arm rotation; and b. when the effect of the explosive forces is sufficiently dissipated, the force of the spring acting on the body and the retainer causing the body and retainer to relatively move in a direction wherein the nose cup is spaced from the arms to avoid interference with said arm rotation.

* * * * *